US008245409B2

(12) United States Patent
Varner et al.

(10) Patent No.: US 8,245,409 B2
(45) Date of Patent: Aug. 21, 2012

(54) BOW SIGHT

(75) Inventors: Joshua Lee Varner, Commerce, MI (US); Nicole Renee Thornton, Dearborn Heights, MI (US); Mark William Lister, Berkley, MI (US); Jerry Glen Sabaldan Elpedes, Milford, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 12/955,033

(22) Filed: Nov. 29, 2010

(65) Prior Publication Data

US 2011/0271535 A1 Nov. 10, 2011

Related U.S. Application Data

(60) Provisional application No. 61/331,106, filed on May 4, 2010.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS 4,166,324 A * 9/1979 Carollo et al. ..... 33/265
5,228,204 A 7/1993 Khoshnood
5,435,068 A * 7/1995 Thames et al. ..... 33/265
5,442,861 A 8/1995 Lorocco
5,465,491 A 11/1995 Thell
RE36,266 E 8/1999 Gibbs
5,941,226 A 8/1999 Marietta
5,975,069 A 11/1999 Hamm et al.
6,000,141 A 12/1999 Afshari
6,119,672 A 9/2000 Closson
6,311,405 B1 11/2001 Slates
6,418,633 B1 7/2002 Rager
6,477,778 B1 11/2002 Lorocco
6,505,407 B2 1/2003 Savage
6,571,482 B1 6/2003 Tymianski
6,581,317 B1 6/2003 Slates
6,601,308 B2 8/2003 Khoshnood
6,609,306 B2 8/2003 Johnson et al.
6,634,110 B2 10/2003 Johnson
6,634,111 B2 10/2003 LoRocco
6,701,632 B2 3/2004 Henry
6,725,854 B1 4/2004 Afshari
D489,427 S 5/2004 Rager
6,817,105 B2 11/2004 LoRocco
6,867,432 B1 3/2005 Teramoto
6,892,462 B2 5/2005 Rager (Continued)

OTHER PUBLICATIONS

Vital Bow Gear, "http://www.vitalbowgear.com/tombstone.cfm".

(Continued)

*Primary Examiner* — G. Bradley Bennett

(74) *Attorney, Agent, or Firm* — Harness, Dickey & Pierce, P.L.C.

(57) ABSTRACT

A sight is provided and may include a housing having a first end, a second end, and an opening extending along a longitudinal axis between the first end and the second end. The sight may also include an optical fiber supported by the housing and a sighting pin having an aiming point extending into the opening of the housing and receiving light from the optical fiber to illuminate the aiming point. The sighting pin may include a longitudinal axis disposed substantially perpendicular to the longitudinal axis of the opening.

33 Claims, 9 Drawing Sheets

U.S. PATENT DOCUMENTS

| | | | |
|---|---|---|---|
| 6,925,721 | B2 | 8/2005 | Dietz |
| 6,964,105 | B2 | 11/2005 | McLeod |
| 7,082,690 | B1 | 8/2006 | Khoshnood |
| 7,100,292 | B2 | 9/2006 | Afshari |
| 7,117,604 | B2 | 10/2006 | Khoshnood |
| 7,159,325 | B2 | 1/2007 | Rager |
| RE39,686 | E | 6/2007 | Khoshnood |
| 7,275,328 | B1 | 10/2007 | Rager |
| 7,278,216 | B2 | 10/2007 | Grace |
| 7,290,345 | B2 | 11/2007 | Ellig |
| 7,308,891 | B2 | 12/2007 | Graf |
| 7,343,686 | B2 | 3/2008 | Rager |
| 7,360,313 | B1 | 4/2008 | Hamm et al. |
| 7,461,460 | B2 | 12/2008 | Priebe |
| 7,475,485 | B1 | 1/2009 | Hamm et al. |
| 7,721,453 | B1 | 5/2010 | Young |
| 7,814,669 | B2 | 10/2010 | Kingsbury |
| 7,832,109 | B2 | 11/2010 | Gibbs et al. |
| 7,900,365 | B1 | 3/2011 | Johnson |
| 8,006,395 | B2 | 8/2011 | Kingsbury |
| 8,051,574 | B1 | 11/2011 | Kronengold et al. |
| 8,069,577 | B1 | 12/2011 | Willman et al. |
| 8,079,153 | B2 | 12/2011 | Pulkrabek et al. |
| 8,151,473 | B2 | 4/2012 | Sims et al. |
| 8,161,656 | B1 | 4/2012 | Ellgass |
| 8,166,662 | B2 | 5/2012 | Williams |
| 8,166,962 | B2 | 5/2012 | Volpe |
| 8,171,648 | B2 | 5/2012 | Summers et al. |
| 8,176,644 | B1 | 5/2012 | Summers et al. |
| 8,186,068 | B2 | 5/2012 | Pulkrabek et al. |
| 2002/0042999 | A1 | 4/2002 | Lorocco |
| 2002/0062569 | A1 | 5/2002 | Slates |
| 2002/0073560 | A1 | 6/2002 | LoRocco |
| 2002/0100176 | A1 | 8/2002 | Savage |
| 2002/0100177 | A1 | 8/2002 | Savage |
| 2002/0112358 | A1 | 8/2002 | Savage |
| 2003/0056379 | A1 | 3/2003 | Johnson et al. |
| 2003/0110647 | A1 | 6/2003 | Henry |
| 2003/0121163 | A1 | 7/2003 | Khoshnood |
| 2006/0254065 | A1 | 11/2006 | Grace |
| 2008/0104854 | A1 | 5/2008 | Hamm et al. |
| 2008/0115373 | A1 | 5/2008 | Rager |
| 2008/0289201 | A1 | 11/2008 | Kroening, Jr. |
| 2009/0000134 | A1 | 1/2009 | Kurtzhals et al. |
| 2009/0133272 | A1 | 5/2009 | Lewis |
| 2009/0139101 | A1 | 6/2009 | Labowski |
| 2010/0258628 | A1 | 10/2010 | Bay |
| 2011/0023311 | A1* | 2/2011 | Williams ..... 33/265 |
| 2011/0072672 | A1 | 3/2011 | Hoffman |
| 2011/0167654 | A1 | 7/2011 | Pulkrabek et al. |
| 2011/0167655 | A1 | 7/2011 | Pulkrabek et al. |
| 2011/0167706 | A1 | 7/2011 | Glock |
| 2011/0214304 | A1 | 9/2011 | Priebe |
| 2011/0271536 | A1 | 11/2011 | Logsdon |
| 2011/0271943 | A1 | 11/2011 | Maynard |
| 2011/0277329 | A1 | 11/2011 | Summers et al. |
| 2012/0102767 | A1 | 5/2012 | Pulkrabek et al. |

OTHER PUBLICATIONS

Inside Archery (magazine), "Vital Bow Gear," Jun. (2004), p. 61.
Cobra Bowhunting Products, "2003 Product Catalog," Cobra Manufacturing Co., Inc., Bixby, OK.
Trophy Ridge, "2003 Catalog," Trophy Ridge, LLC, Belgrade, MT.
TRUGLO, "2003 Catalog," TRUGLO, Inc., McKinney, TX.

* cited by examiner

BOW SIGHT

CROSS-REFERENCE TO RELATED APPLICATIONS

This application claims the benefit of U.S. Provisional Application No. 61/331,106, filed on May 4, 2010. The entire disclosure of the above application is incorporated herein by reference.

FIELD

The present disclosure relates to sights and more particularly to a sight incorporating an optical fiber for use in conjunction with a weapon.

BACKGROUND

This section provides background information related to the present disclosure which is not necessarily prior art.

Sights are often used in conjunction with weapons to aid a user in properly aligning the weapon with a target. For example, hunters and competitive archers typically use a sight in conjunction with a bow to properly align the bow with a target. Proper alignment of the bow with the target is essential to ensure that an arrow fired by the bow impacts the target at a desired location.

Conventional sights may be rigidly mounted relative to a frame of a weapon such as, for example, a bow to fix a position of the sight relative to the weapon. As such, alignment of the sight with a target likewise aligns the weapon relative to the target and increases the likelihood that a projectile shot from the weapon will properly strike the target at a desired location.

An aiming point may be used to aid a user in aligning the sight with a target. In one configuration, a post is fixed relative to the sight and serves as the aiming point. In another configuration, a distal end of an illuminated, optical fiber is used in conjunction with a support structure and functions as the aiming point.

While conventional sights provide structure that aids a user in aligning a weapon relative to a target, such sights are costly and complicated to manufacture. Furthermore, while some sights provide a user with an illuminated aiming point, such sights are somewhat fragile and difficult to repair, as the fiber is typically exposed to ambient conditions to allow a distal end of the fiber to serve as an aiming point. Such exposed fibers must be supported by a structure of the sight, thereby adding to the overall cost, weight, and complexity of the sight.

SUMMARY

This section provides a general summary of the disclosure, and is not a comprehensive disclosure of its full scope or all of its features.

A sight is provided and may include a housing having a first end, a second end, and an opening extending along a longitudinal axis between the first end and the second end. The sight may also include an optical fiber supported by the housing and a sighting pin having an aiming point extending into the opening of the housing and receiving light from the optical fiber to illuminate the aiming point. The sighting pin may include a longitudinal axis disposed substantially perpendicular to the longitudinal axis of the opening.

In another configuration, a sight is provided and may include a housing having a first end, a second end, and an opening extending along a longitudinal axis between the first end and the second end. The sight may also include an optical fiber supported by the housing and a sighting pin extending into the opening of the housing and in optical communication with the optical fiber. The sighting pin may include an aiming point disposed at a distal end thereof that opposes an inner surface of the housing and is illuminated with light received from the optical fiber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
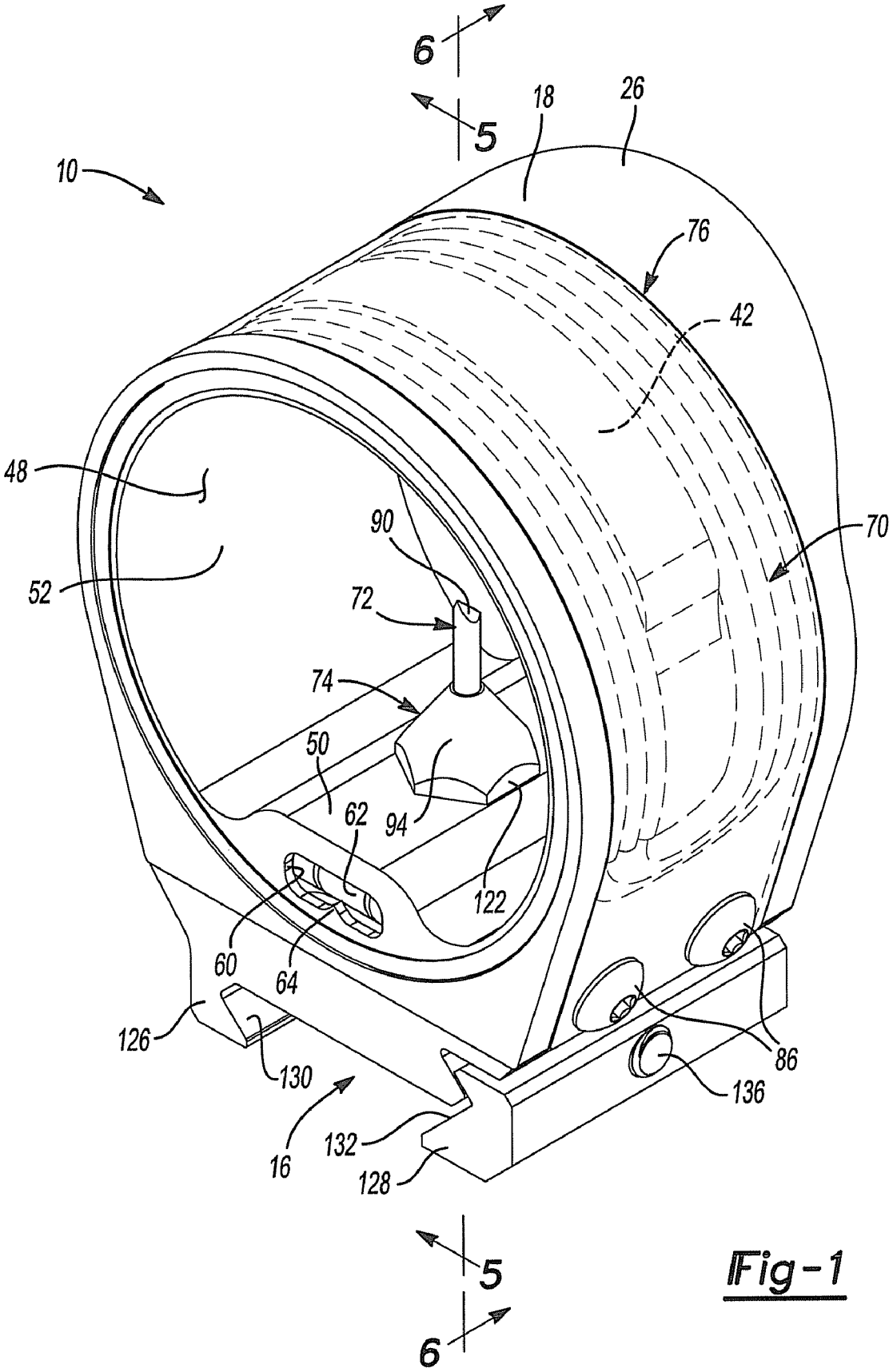
FIG. 1 is a perspective view of a sight in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, a sight 10 is provided. The sight 10 may include a housing 12, an illumination system 14, and an attachment assembly 16. The housing 12 and attachment assembly 16 cooperate to position the illumination system 14 relative to an external structure (not shown) to allow the illumination system 14 to aid a user in properly aligning the external structure relative to a target (not shown). In one configuration, the external structure is a weapon such as, for example, a bow, whereby the attachment assembly 16 attaches and positions the housing 12 relative to the bow and the illumination system 14 provides an aiming point for aiding a user in aligning the bow (via sight 10) relative to a target. The sight 10 may also be used with a mount such as the bow-sight mount disclosed in Assignee's commonly owned U.S. patent application titled "Bow-Sight Mount" filed concurrently herewith and incorporated herein by reference. While the sight 10 is described as being associated with a bow, the sight 10 could be used to align virtually any structure relative to a target and is not limited solely for use in conjunction with a weapon.

The housing 12 may include a first portion 18, a second portion 20, and a third portion 22 recessed from and disposed between the first portion 18 and the second portion 20. The first portion 18 may include a front face 24 opposing a target when in use, as well as a lip 26 extending generally over an opening 28 of the housing 12. The lip 26 is positioned and extends farther from the opening 28 than does the front face 24 to shield the opening 28 from ambient light to prevent ambient light from interfering with operation of the illumination system 14.

Figure 5:
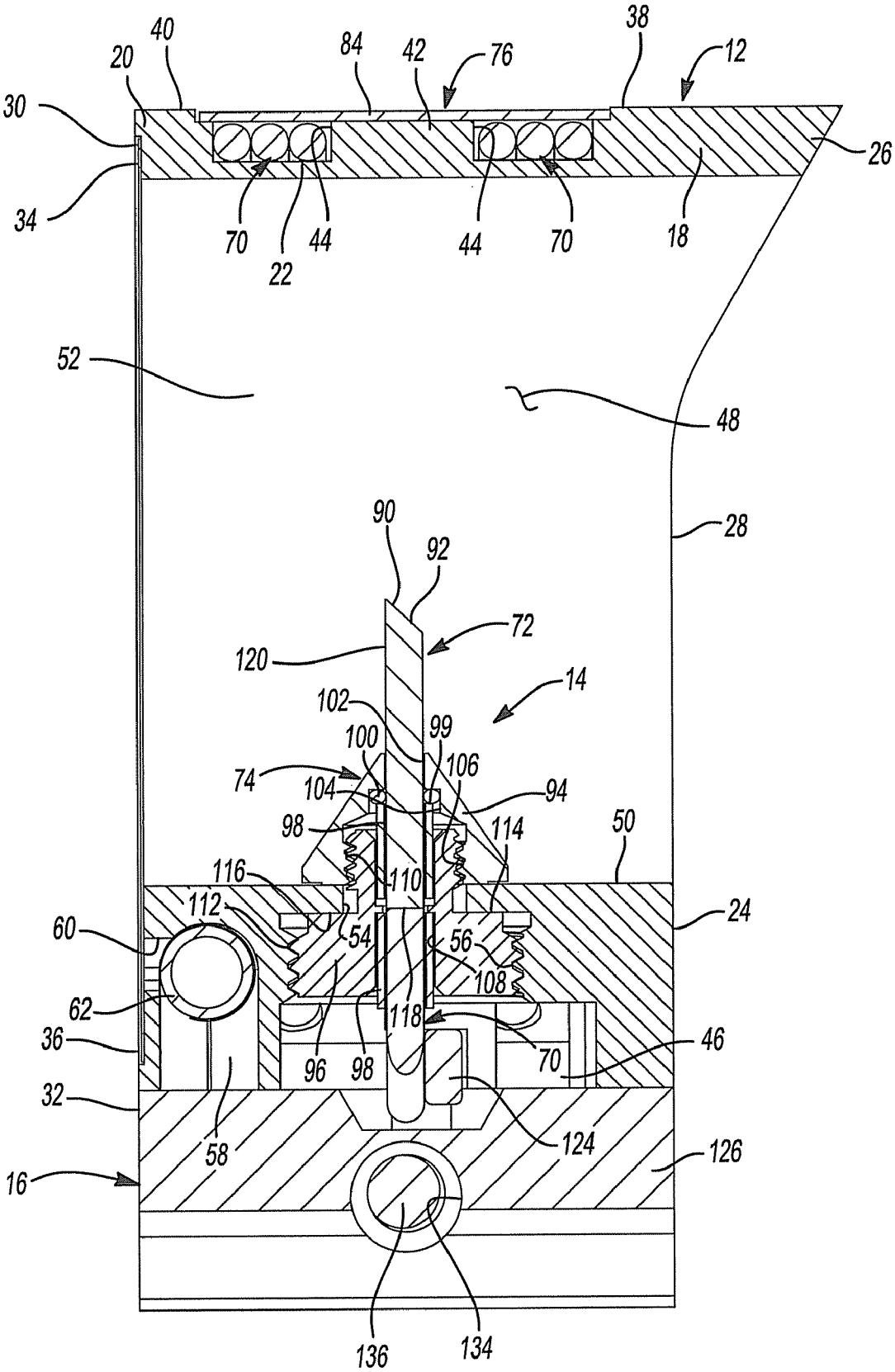
FIG. 5 is a cross-sectional view of the sight of FIG. 1 taken along line 5-5.

The second portion 20 may be disposed on an opposite end of the housing 12 from the first portion 18 and may include a recess 30 having a substantially circular shape as well as a front face 32. The recess 30 may be recessed from the front face 32 and may receive a generally circular alignment tape 34 therein. The alignment tape 34 may include a substantially circular shape and may be formed from a fluorescent or other highly visible material that aids a user in aligning the housing 12 with a target and/or identifying the opening 28 of the housing 12. In one configuration, the alignment tape 34 includes an adhesive (not shown) that adheres the alignment tape 34 to the second portion 20 of the housing 12 generally within the recess 30. Once the alignment tape 34 is installed and received within the recess 30, an outer surface 36 of the alignment tape 34 may be substantially flush with the front face 32 (FIG. 5).

The third portion 22 may be recessed from an outer surface 38 of the first portion 18 and from an outer surface 40 of the second portion 20. A rib 42 may be disposed within the third portion 22 between the first portion 18 and the second portion 20 and may define a pair of channels 44. In one configuration, the rib 42 is disposed at a central location of the third portion 22 such that the channels 44 defined by the rib 42 in cooperation with the first portion 18 and the second portion 20 include a substantially identical width (FIG. 5).

The third portion 22 may also include an opening 46 disposed at an opposite end of the housing 12 than the rib 42. The opening 46 may be defined generally between the first portion 18 and the second portion 20 and may at least partially receive a portion of the illumination system 14 and attachment assembly 16 therein.

The first portion 18, second portion 20, and third portion 22 may cooperate to provide the housing 12 with a substantially uniform inner surface 48 and a ledge 50 extending generally between the front face 24 of the first portion 18 and the front face 32 of the second portion 20. As described, the inner surface 48 of the housing 12 provides the housing 12 with a substantially circular shape extending between the front face 24 of the first portion 18 and the front face 32 of the second portion 20. The circular shape defined by the inner surface 48 may terminate at the ledge 50, which may extend into an open area 52 generally towards the inner surface 48. The ledge 50 may include an aperture 54 in communication with a threaded bore 56 that cooperate to position a portion of the illumination system 14 relative to the housing 12. The aperture 54 and threaded bore 56 may be in communication with the opening 46 of the third portion 22 to allow a portion of the illumination system 14 to be inserted into the aperture 54 and threaded bore 56 at the opening 46 generally between the first portion 18 and the second portion 20.

The ledge 50 may additionally include a pocket 58 (FIG. 5) and a window 60 in fluid communication with the pocket 58. The pocket 58 may be sized to matingly receive a bubble level 62 therein to aid a user in properly aligning the housing 12 and, thus, the sight 10 relative to an external structure and/or to ensure that the housing 12 is level. Because the window 60 is in fluid communication with the pocket 58, the bubble level 62 is visible through the window 60 once inserted into the pocket 58.

Figure 2:
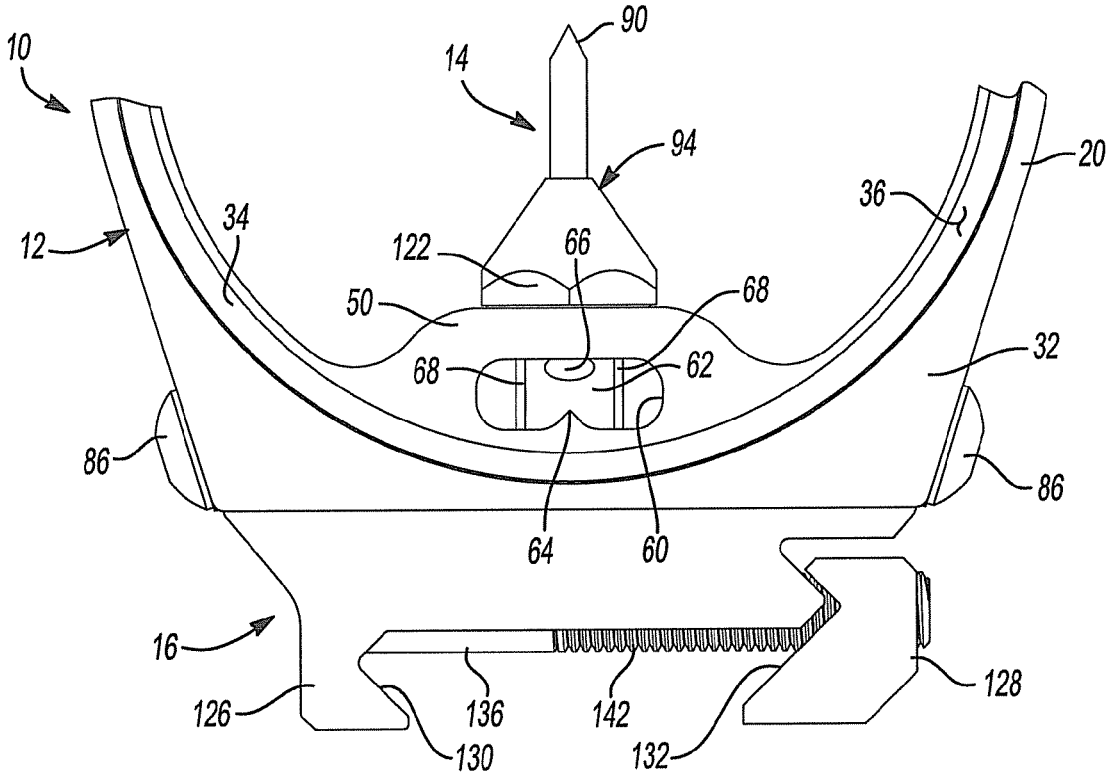
FIG. 2 is a partial-front view of the sight of FIG. 1 detailing a level and attachment portion of the sight.
Figure 3:
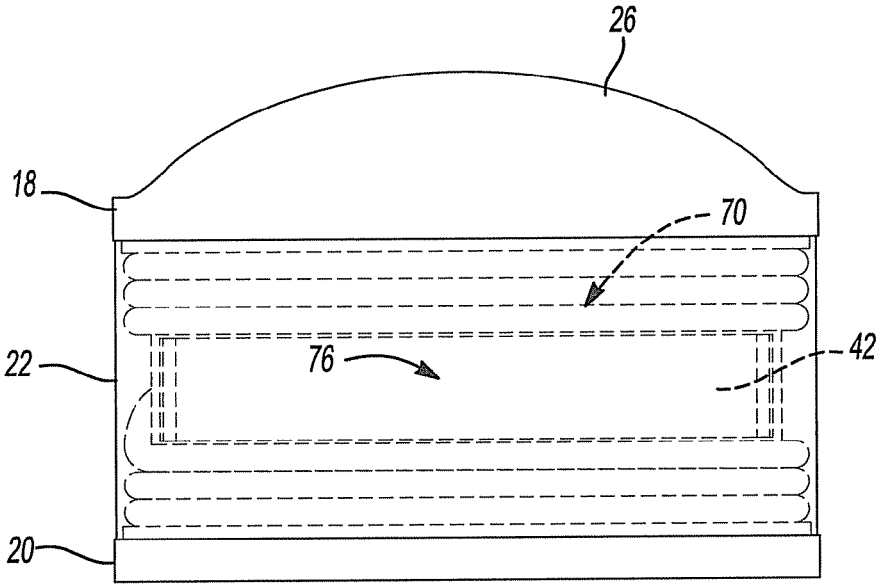
FIG. 3 is a top view of the sight of FIG. 1.
Figure 4:
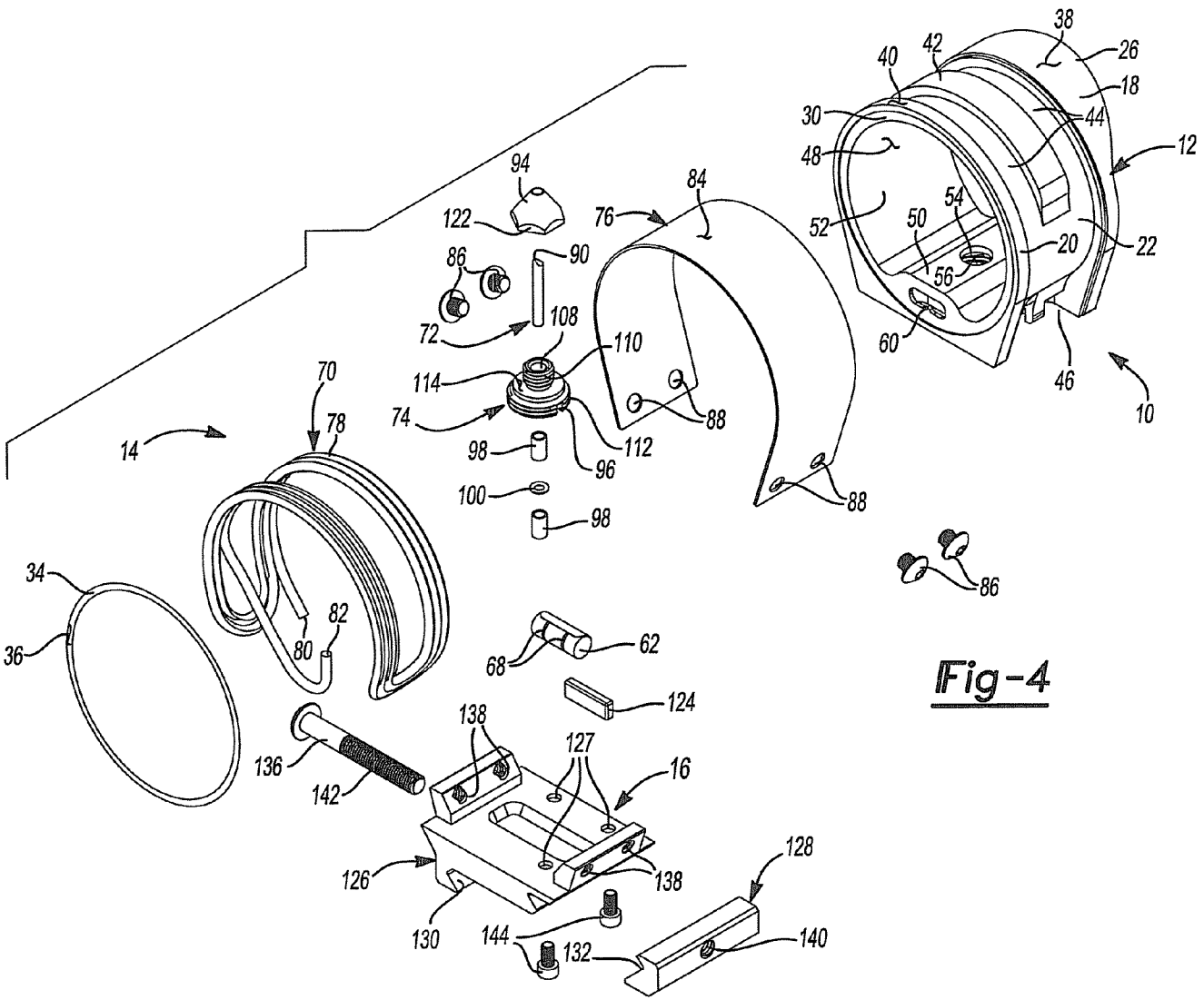
FIG. 4 is an exploded view of the sight of FIG. 1.

As shown in FIG. 2, the window 60 may be formed in the front face 32 of the second portion 20 such that the window 60 fully encases the bubble level 62. Encasing the bubble level 62 such that the housing 12 fully surrounds the bubble level 62 at the window 60 protects the bubble level 62 and minimizes the viewable portion of the bubble level 62 to only that which is required by the user. The window 60 may include a substantially oval shape or, alternatively, may include an alignment point 64 to aid a user in aligning a bubble 66 of the bubble level 62 relative to the housing 12 and between two graduation marks 68 formed in or on the bubble level 62 (FIG. 2).

With particular reference to FIGS. 4-8, the illumination system 14 is shown and may include an optical fiber 70, a sighting pin 72, a fitting assembly 74, and a cover 76. The optical fiber 70 may include a diameter of approximately two millimeters (0.079 inches) and may be formed from virtually any color. For example, the optical fiber 70 may be formed from green, red, or orange fibers to provide the sighting pin 72 with a desired color. The optical fiber 70 may be formed in a "racetrack" configuration, whereby the optical fiber 70 is wound in a substantially oval or serpentine shape prior to being inserted into the channels 44 of the housing 12 (FIG. 5). While the optical fiber 70 is described as being wound into a substantially oval or serpentine shape prior to being positioned within the channels 44, the optical fiber 70 could alternatively be formed into the "racetrack" configuration while concurrently installing the optical fiber 70 in the channels 44. Specifically, the optical fiber 70 may be wound around the rib 42 and within the third portion 22 of the housing 12 into the shape shown in FIG. 4. In either configuration, the rib 42 may cooperate with the first portion 18 and the second portion 20 of the housing 12 to properly position the optical fiber 70 within the third portion 22 of the housing 12.

In one configuration, the width of each channel 44 is determined by a width of three strands of the optical fiber 70, as shown in FIG. 5. For example, if the optical fiber 70 includes a diameter substantially equal to two millimeters, a width of each channel 44 may be approximately equal to six millimeters such that when the optical fiber 70 is positioned within each channel 44, the optical fiber 70 is held in place within each channel 44 by a surface of the rib 42 and a surface of either the first portion 18 or the second portion 20 of the housing 12.

The portion of the optical fiber 70 received generally within the channels 44 may constitute a wound portion 78 (FIG. 4) that begins at a first end 80 and terminates at a second end 82. The second end 82 may be received within the opening 46 of the third portion 22 such that the second end 82 extends into the opening 46 and opposes the sighting pin 72 to illuminate the sighting pin 72, as will be described further below.

The cover 76 may be formed from a transparent material that protects the optical fiber 70 from damage while concurrently allowing ambient light to be received by the optical fiber 70. The cover 76 may be received within the third portion 22 of the housing 12 such that an outer surface 84 of the cover 76 is substantially flush with the outer surfaces 38, 40 of the first and second portions 18, 20 of the housing 12 when the cover 76 is installed. The cover 76 may be attached to the housing 12 by a series of fasteners 86 that extend through apertures 88 of the cover 76 and are threadably received within bores 138 of the housing 12 and/or attachment assembly 16. When the threaded fasteners 86 are received within the apertures 88 and secured to the housing 12 and/or attachment assembly 16, the cover 76 is fixedly attached to the housing 12 and restricts removal of the optical fiber 70 from the channels 44. In this regard, the cover 76 not only protects the optical fiber 70 but also aides in restricting removal of the optical fiber 70—inadvertent or otherwise—from the channels 44.

The sighting pin 72 may be at least partially received within the aperture 54 of the ledge 50 and may extend upwardly from the ledge 50 toward the inner surface 48 of the housing 12. The sighting pin 72 may be a clear fiber being relatively rigid when compared to the optical fiber 70. Alternatively, the sighting pin 72 could include the same or similar rigidity as the optical fiber 70 if the sighting pin 72 and optical fiber 70 include approximately the same diameter. Regardless of the particular diameter of the optical fiber 70 and sighting pin 72, the sighting pin 72 may be sufficiently rigid such that the sighting pin 72 is self-supporting, as will be described further below. The sighting pin 72 may be polished such that a tip 90 of the sighting pin 72 appears as a colored triangle when coupled to and receiving light from the optical fiber 70, as will be described in greater detail below. The sighting pin 72 and associated tip 90 may be of the type discloses in assignee's commonly owned U.S. Pat. No. 5,924,234 issued on Jul. 20, 1999, the disclosure of which is incorporated herein by reference.

While the sighting pin 72 is described as including a tip 90 at a distal end of the sighting pin 72 having a substantially triangular shape, the distal end of the sighting pin 72 could include a different shape to provide an aiming point other than a triangular-aiming point. For example, in one configuration, the tip 90 of the sighting pin 72 may be formed such that the tip 90 provides an oval, circular, or "D" shaped aiming point for use by the user in aligning the tip 90 with a target. Regardless of the particular construction of the tip 90, the sighting pin 72 may be formed from a clear fiber that receives light from the optical fiber 70 for illumination of the tip 90. Illumination of the tip 90 provides the user with an illuminated aiming point 92 for use by a user in aligning an external structure such as, for example, a bow, with a target.

Regardless of the particular configuration of the tip 90 of the sighting pin 72, the sighting pin 72 may include a diameter similar to the diameter of the optical fiber 70. For example, the sighting pin 72 may include a diameter substantially equal to two millimeters (0.079 inches) such that the diameter of the sighting pin 72 approximates or is identical to that of the optical fiber 70. Providing the optical fiber 70 with a diameter approximating two millimeters enhances the ability of the optical fiber 70 to gather ambient light. Likewise, providing the sighting pin 72 with a diameter approximating two millimeters allows the sighting pin 72 to maximize the amount of light received from the optical fiber 70 and, thus, the amount of light used in illuminating the tip 90.

The fitting assembly 74 may be at least partially disposed within the aperture 54 of the ledge 50 and may cooperate with the optical fiber 70 and the sighting pin 72 to position the second end 82 of the optical fiber 70 and the sighting pin 72 relative to the open area 52 of the housing 12. The fitting assembly 74 may include a collar 94, a base 96, a sleeve or pair of sleeves 98, and a seal member 100. The collar 94 may include a shape approximating that of a frustum and may include a first bore 102, a second bore 104 adjacent to the first bore 102 and having a larger diameter than that of the first bore 102, and a threaded bore 106.

The base 96 may include a bore 108 extending therethrough, a first threaded portion 110, and a second threaded portion 112 disposed adjacent to the first threaded portion 110. The second threaded portion 112 may include a larger diameter than the first threaded portion 110 such that an engagement surface 114 is disposed generally between the first threaded portion 110 and the second threaded portion 112.

In operation, the fitting assembly 74 may cooperate with the ledge 50 of the housing 12 to position the second end 82 of the optical fiber 70 and the sighting pin 72 relative to the open area 52 of the housing 12. Specifically, the base 96 is received generally within the aperture 54 of the ledge 50 such that the second threaded portion 112 threadably engages the threaded bore 56 of the aperture 54. When the second threaded portion 112 engages the threaded bore 56 of the ledge 50, the first threaded portion 110 of the base 96 extends generally through the aperture 54 and into the open area 52 of the housing 12. The extent to which the first threaded portion 110 extends into the open area 52 of the housing 12 may be determined based on the engagement surface 114 of the base 96. Specifically, as the base 96 is installed in the housing 12 and is rotated relative to the threaded bore 56, the base 96 moves relative to the housing 12, thereby causing the first threaded portion 110 of the base 96 to extend into the open area 52. The base 96 will continue to move relative to the housing 12 until the engagement surface 114 contacts a bottom surface 116 (FIG. 5) of the housing 12 proximate to the aperture 54. Once the engagement surface 114 contacts the bottom surface 116 of the housing 12, the base 96 can no longer be rotated relative to the housing 12 to advance the first threaded portion 110 farther into the open area 52 of the housing 12.

Once the engagement surface 114 is in contact with the bottom surface 116, the first threaded portion 110 of the base 96 may extend through the aperture 54 and into the open area 52 of the housing 12. The first threaded portion 110 may threadably receive the threaded bore 106 of the collar 94 to retain and position the sighting pin 72 relative to the housing 12 and optical fiber 70. Specifically, the optical fiber 70 may be received within the bore 108 of the base 96 and may be positioned by an assembly tool, so the second end 82 is positioned a desired distance from ledge 50. The optical fiber 70 may be attached to the base 96 within the bore 108 of the base 96 using an adhesive such as, for example epoxy, to retain the optical fiber 70 within the base 96.

The sighting pin 72 may also be received within the bore 108 of the base 96 and may be positioned and secured within the bore 108 by sleeve 98. The sleeve 98 may be attached to the sighting pin 72 by way of a suitable adhesive such as, for example, epoxy. The sleeve 98 associated with the sighting pin 72 is not fixedly attached to the base 96 within the bore 108 to allow the sighting pin 72 to be replaced or repaired.

The sighting pin 72, once received within the bore 108, may be positioned relative to the second end 82 of the optical fiber 70 such that an end 118 of the sighting pin 72 opposes the second end 82 of the optical fiber 70. As such, light from the optical fiber 70 is permitted to exit the second end 82 of the optical fiber 70 and is received by the end 118 of the sighting pin 72 for use by the sighting pin 72 in illuminating the tip 90 and providing a user of the sight 10 with the illuminated aiming point 92.

The sighting pin 72 may be inserted into the bore 108 concurrently with positioning of the collar 94 relative to the base 96. The sighting pin 72 may be retained within the second bore 104 of the collar 94 due to interaction between an outer surface 120 of the sighting pin 72 and the seal member 100 to allow the sighting pin 72 to move with the collar 94 prior to the collar 94 being installed on the base 96.

In one configuration, the seal member 100 is an O-ring that is compressed when the sighting pin 72 is received within the second bore 104 of the collar 94. Compression of the seal member 100 between the outer surface 120 of the sighting pin 72 and the second bore 104 of the collar 94 allows the sighting pin 72 to be retained within the collar 94 prior to the collar 94 engaging the first threaded portion 110 of the base 96.

When the collar 94 is positioned relative to the first threaded portion 110 of the base 96, the threaded bore 106 engages the first threaded portion 110 and the sighting pin 72 is received within the bore 108 of the base 96. As the collar 94 is rotated relative to the first threaded portion 110 of the base 96, the end 118 of the sighting pin 72 is brought into close proximity with the second end 82 of the optical fiber 70. Additionally, as the collar 94 is rotated relative to the first threaded portion 110, the collar 94 advances toward to the ledge 50 and the seal member 100 is compressed between the distal end 99 of the sleeve 98 and an inner surface of the second bore 104, thereby retaining the sighting pin 72 within the collar 94 and restricting movement of the sighting pin 72 relative to the housing 12.

In one configuration, the sighting pin 72 may be positioned relative to the collar 94 such that once the collar 94 is fully installed on the base 96, the end 118 of the sighting pin 72 is in an abutting relationship with the second end 82 of the optical fiber 70. In another configuration, a slight gap (not shown) may be disposed between the end 118 of the sighting pin 72 and the second end 82 of the optical fiber 70. Regardless of the particular position of the second end 82 of the optical fiber 70 and the end 118 of the sighting pin 72, light from the optical fiber 70 is transmitted to the sighting pin 72 for use by the sighting pin 72 in illuminating the tip 90.

The collar 94 may include a series of flats 122 (FIG. 4) for mating engagement with a tool (not shown) that facilitates rotation of the collar 94 relative to the base 96. The collar 94 may be rotated by the tool until the collar 94 engages the ledge 50 such that a portion of the ledge 50 is disposed and compressed between the collar 94 and the engagement surface 114 of the base 96. Positioning the portion of the ledge 50 between the collar 94 and the base 96 retains the collar 94 and base 96 within the aperture 54. Because the sighting pin 72 is received within the bores 102, 104 of the collar 94 and retained therein due to engagement between the distal end 99 of the sleeve 98, the seal member 100, and the second bore 104 of the collar 94, the sighting pin 72 is likewise retained within and positioned relative to the open area 52 of the housing 12.

As described above, the sighting pin 72 is retained within the first and second bores 102, 104 of the collar 94 due to engagement of the sleeve 98 and the seal member 100 when the collar 94 is installed on the base 96. As such, applying a force on the sighting pin 72 substantially along a longitudinal axis of the sighting pin 72 prevents removal of the sighting pin 72 from the collar 94 when the collar 94 is installed on the base 96. However, the sighting pin 72 can be removed from the collar 94 when the collar 94 is removed from the base 96 by applying a force to the sighting pin 72 in a direction generally away from the seal member 100. Removal of the sighting pin 72 from the collar 94 permits a user to clean the sighting pin 72 and/or replace a broken or damaged sighting pin 72 without having to replace or adjust the optical fiber 70. Furthermore, allowing replacement of the sighting pin 72 permits a user to use different sighting pins 72 possibly incorporating tips 90 of different shapes. As described above and shown in assignee's commonly-owned U.S. Pat. No. 5,924, 234, which is incorporated herein by reference, the distal end of the sighting pin 72 may include any number of shapes that provide the user with an illuminated aiming point 92 having a desired shape.

In order to remove the sighting pin 72 from the housing 12, a tool may engage the flats 122 to rotate the collar 94 relative to the housing 12. Once the collar 94 disengages the first threaded portion 110 of the base 96, a force may be applied substantially along a longitudinal axis of the sighting pin 72 in a direction such that a distal end 99 of the sleeve 98 disengages the seal member 100. Once the sighting pin 72 is removed, the sighting pin 72 may be repaired or replaced and then inserted once again first into the threaded bore 106 of the collar 94 and then through the first and second bores 102, 104 of the collar 94. The sighting pin 72 is inserted into the first and second bores 102, 104 until the distal end 99 of the sleeve 98 contacts the seal member 100. At this point, the collar 94 may again threadably engage the first threaded portion 110 of the base 96 to position the sighting pin 72 within the housing 12. The collar 94 may be rotated until the collar 94 contacts the ledge 50, at which point the end 118 of the sighting pin 72 contacts the second end 82 of the optical fiber 70 and the seal member 100 is compressed by the sleeve 98. As described above, compressing the seal member 100 via the sleeve 98 retains the sighting pin 72 relative to the collar 94 and, thus, retains the sighting pin 72 relative to the housing 12.

The illumination system 14 may additionally include a Tritium lamp 124 disposed proximate to the second end 82 of the optical fiber 70. The Tritium lamp 124 may selectively supply light to the optical fiber 70 to allow the optical fiber 70 to illuminate the sighting pin 72. The Tritium lamp 124 may be used in low-ambient light conditions where insufficient ambient light is received by the optical fiber 70 and the optical fiber 70 is not capable of sufficiently illuminating the tip 90 of the sighting pin 72. While the Tritium lamp 124 is described as being disposed proximate to the second end 82 of the optical fiber 70, the Tritium lamp 124 could be disposed at any point along the length of the optical fiber 70, provided the Tritium lamp 124 provides the optical fiber 70 with light.

As described above, the sighting pin 72 may be relatively rigid. As such, the sighting pin 72 is self-supporting in that additional structure is not required to support the tip 90 of the sighting pin 72 relative to the housing 12. While the sighting pin 72 is retained and positioned by the fitting assembly 74, the fitting assembly 74 does not support the tip 90 within the housing 12. Rather, because the sighting pin 72 is formed from a relatively rigid and self-supporting material, attaching the sighting pin 72 generally at a base of the sighting pin 72 via the fitting assembly 74 allows the tip 90 to be positioned within the open area 52 of the housing 12 without requiring the tip 90 to be supported by the fitting assembly 74 or otherwise.

While a self-supporting sighting pin 72 is described as being used in conjunction with the optical fiber 70, the optical fiber 70 could alternatively be used in conjunction with a relatively flexible fiber 73 to generate the illuminated aiming point 92. For example, the second end 82 of the optical fiber 70 could be in an abutting relationship with an end 75 of the flexible fiber 73 to provide the flexible fiber 73 with light. The flexible fiber 73 may extend through the collar 94 and base 96 in a similar fashion as the sighting pin 72 and may be supported by a tube 77. The tube 77 may include a first arm 79 extending though the collar 94 and base 96, a second arm 81 extending substantially ninety degrees (90°) relative to the first arm 79, and a passageway 83 extending along a length of the tube 77 through the first arm 79 and second arm 81.

The flexible fiber 73 may be a clear fiber such that color of the light supplied to the illuminated aiming point 92 is dictated by the color of the optical fiber 70 and may include a reduced diameter when compared to the optical fiber 70. While the flexible fiber 73 is described as being a clear fiber and of a reduced diameter when compared to the optical fiber 70, the flexible fiber 73 could include any size and virtually any color. As such, the flexible fiber 73 could cooperate with the optical fiber 70 to likewise provide the illuminated aiming point 92 with virtually any color.

Figure 7:
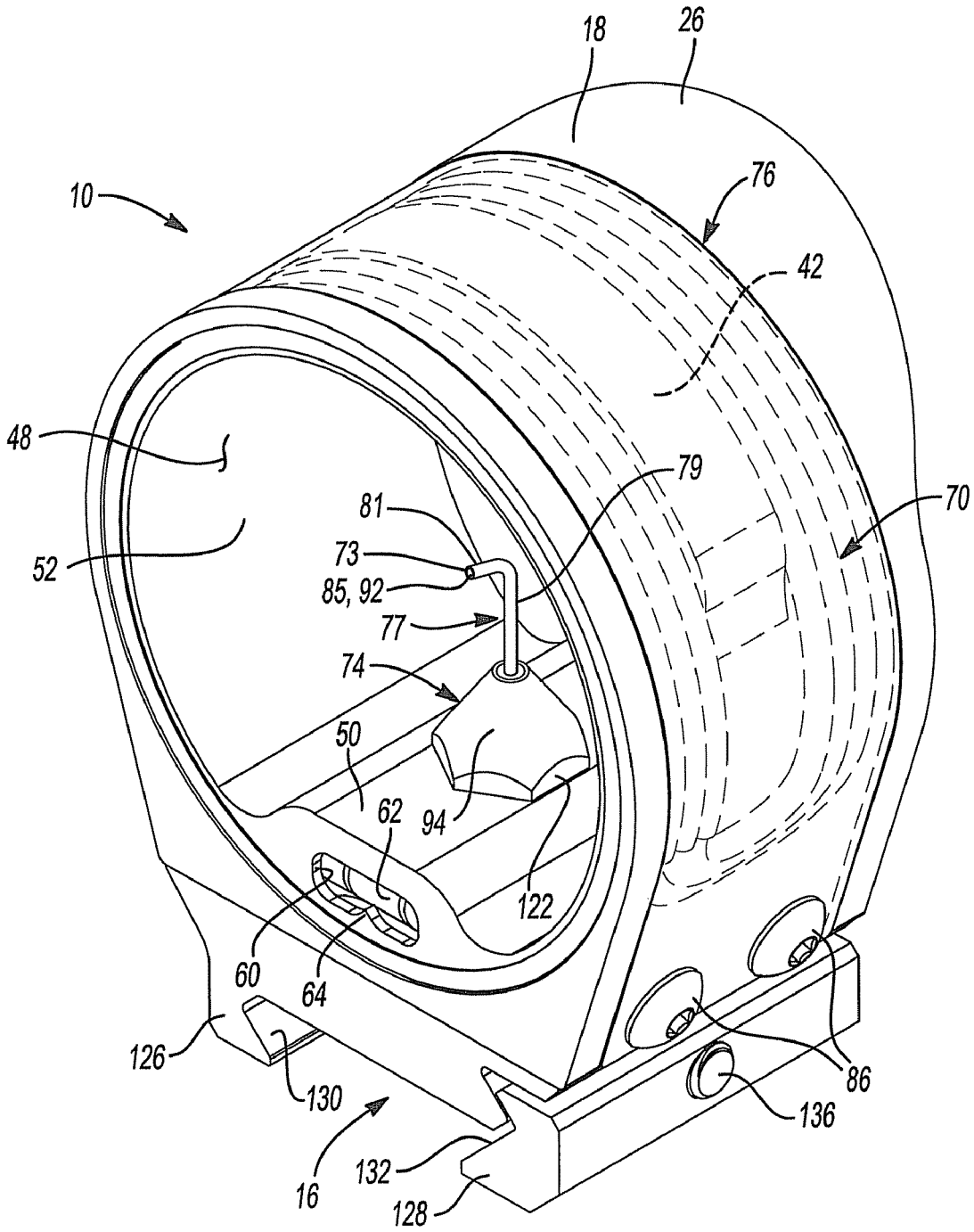
FIG. 7 is a perspective view of a sight in accordance with the principles of the present disclosure incorporating an illumination system.
Figure 8:
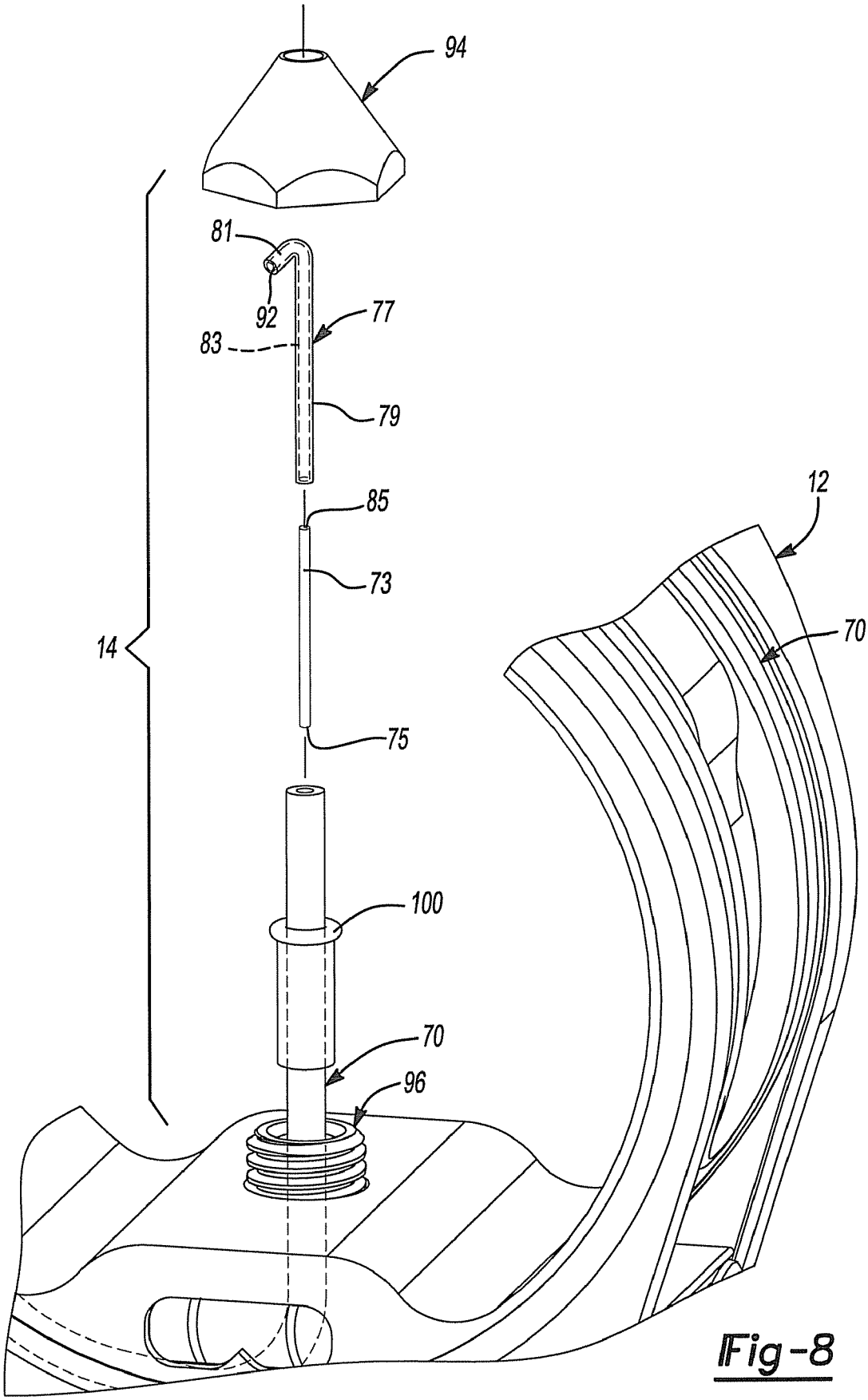
FIG. 8 is an exploded view of the illumination system of FIG. 7.
Figure 9:
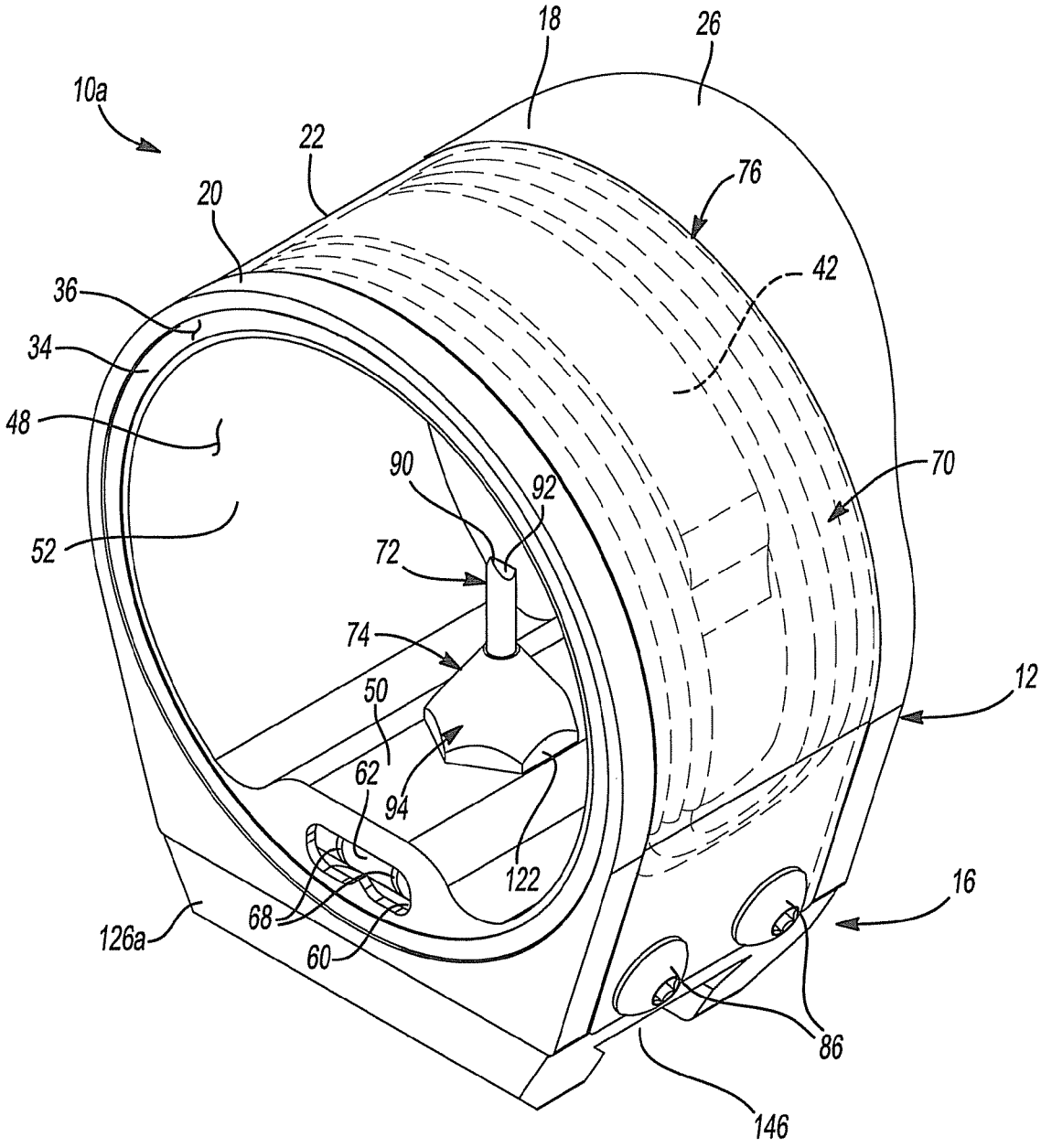
FIG. 9 is a perspective view of a sight in accordance with the principles of the present disclosure.
Figure 10:
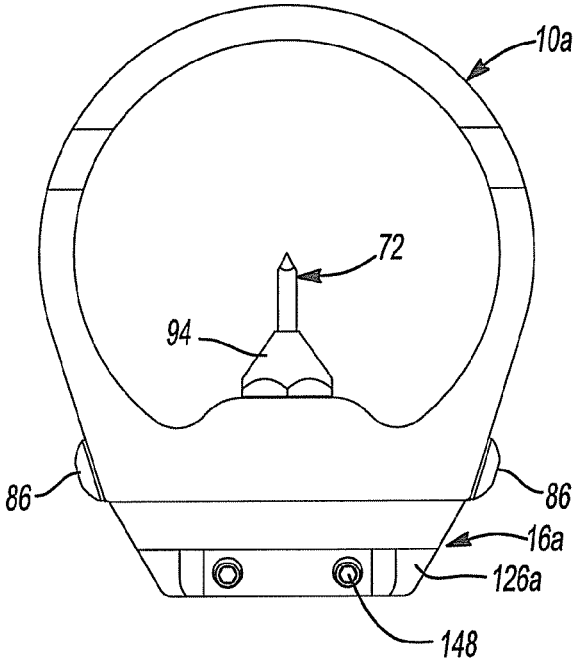
FIG. 10 is a rear view of the sight of FIG. 9.
Figure 11:
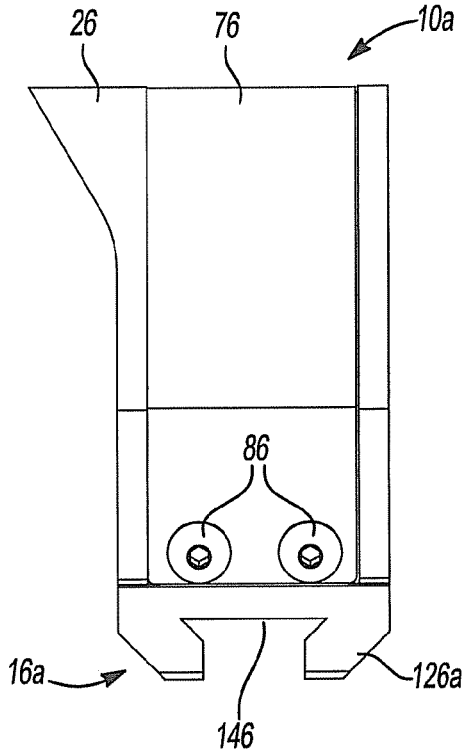
FIG. 11 is a side view of the sight of FIG. 9.
Figure 12:
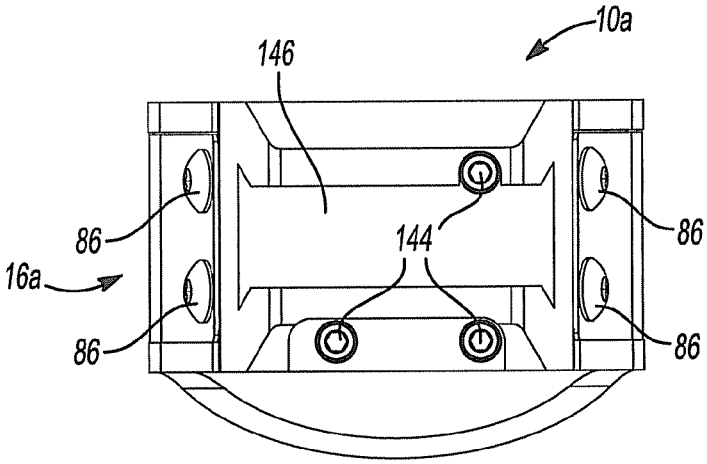
FIG. 12 is a bottom view of the sight of FIG. 9.

Regardless of the color of the flexible fiber 73, the flexible fiber 73 extends substantially through the first arm 79 and into the second arm 81 such that the flexible fiber 73 similarly includes a ninety-degree (90°) bend. Positioning the flexible fiber 73 within the tube 77 such that the flexible fiber 73 is bent substantially ninety degrees (90°) allows a distal end 85 of the flexible fiber 73 to extend along and in substantially the same direction as a longitudinal axis of the second arm 81 (FIGS. 7 and 8). As such, the distal end 85 of the flexible fiber 73 may be positioned so as to oppose an opening of the housing 12 defined by the alignment tape 34 such that the end 85 opposes a user and provides the illuminated aiming point 92. Because the flexible fiber 73 and tube 77 include a substantially circular cross section, the illuminated aiming point 92 likewise includes a substantially circular shape in this configuration.

Figure 6:
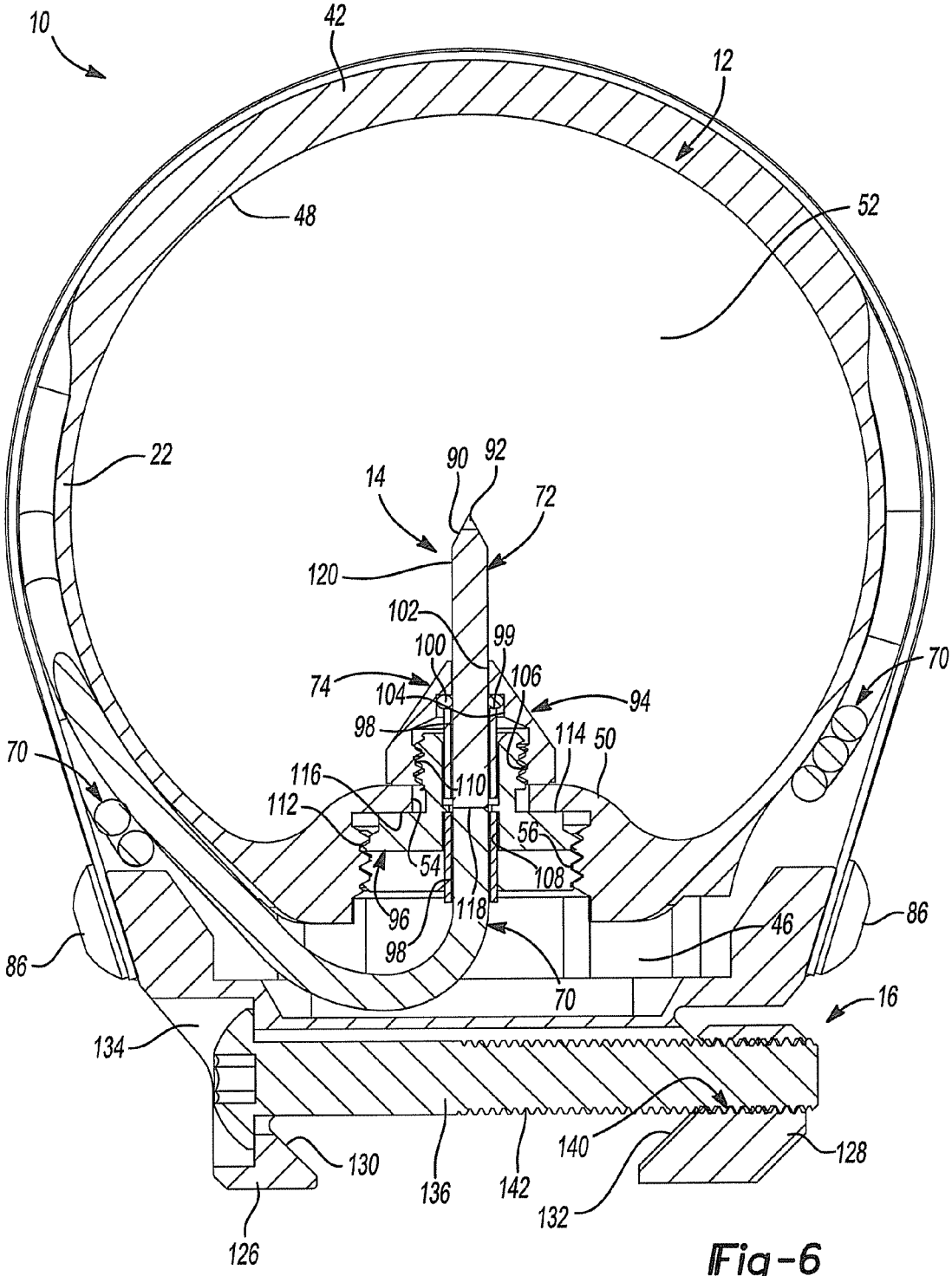
FIG. 6 is a cross-sectional view of the sight of FIG. 1 taken along line 6-6.

With particular reference to FIGS. 2 and 6, the attachment assembly 16 will be described in detail. The attachment assembly 16 may include a bracket 126 and a locking member 128 that cooperate to attach the housing 12 to the external structure. In one configuration, the external structure may include a Picatinny rail or a Weaver rail (neither shown) that cooperates with the attachment assembly 16 to attach the housing 12 to the rail. The bracket 126 may include a pocket 130 that cooperates with a pocket 132 of the locking member 128 such that the pockets 130, 132 cooperate to form a female portion that matingly receives a male portion of the rail. The bracket 126 may include an aperture 134 that receives a fastener 136 and may also include a series of threaded bores 138 that matingly receive the fasteners 86 to retain the cover 76 relative to the housing 12. The bracket 126 may also include at least one aperture 127 that receives a fastener 144 to secure the bracket 126 relative to the housing 12. The locking member 128 may include a threaded aperture 140 that threadably receives the fastener 136 and may cooperate with the pocket 130 of the bracket 126 to provide the sight 10 with a female portion that cooperates with a male portion of the rail.

In operation, the sight 10 may be positioned relative to a rail such that the male portion of the rail is received within the female portion of the attachment assembly 16. Specifically, the rail may be received within the pocket 130 of the bracket 126 and within the pocket 132 of the locking member 128. Once the rail is received within the pockets 130, 132, the fastener 136 may be rotated relative to the bracket 126 and the locking member 128. Rotation of the fastener 136 relative to the bracket 126 and the locking member 128 causes a threaded portion 142 of the fastener 136 to engage the threaded aperture 140 of the locking member 128 to draw the locking member 128 closer to the bracket 126 to retain the male portion of the rail generally within and between the pocket 130 of the bracket 126 and the pocket 132 of the locking member 128.

While the sight 10 is described as being used in conjunction with a Picatinny rail or a Weaver rail, the sight 10 could also be used in conjunction with virtually any rail. For example, the sight 10 may be used in conjunction with a dove-tail rail (not shown) extending substantially ninety degrees (90°) relative to a Picatinny rail or Weaver rail (FIGS. 9-12). If the sight 10 is used in conjunction with such a dove-tail rail, the sight 10 may include an attachment assembly 16*a* having a different configuration to accommodate the dove-tail rail.

In view of the substantial similarity in structure and function of the components associated with the sight 10 with respect to the sight 10*a*, like reference numerals are used hereinafter and in the drawings to identify like components while like reference numerals containing letter extensions are used to identify those components that have been modified.

If the sight 10*a* is used in conjunction with a dove-tail rail, the attachment assembly 16*a* may include a bracket 126*a* having a passageway 146 shaped and configured to accommodate the dove-tail rail.

In operation, when the sight 10*a* is installed on the dove-tail rail, a male portion of the dove-tail rail is received within the passageway 146. Once the sight 10*a* is properly positioned relative to the dove-tail rail, a series of set screws 148 may be rotated to fix a position of the sight 10*a* relative to the dove-tail rail.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A sight comprising:

a housing including a first end, a second end, and an opening extending along a longitudinal axis between said first end and said second end;

an optical fiber supported by said housing; and a sighting pin including a polished first end providing an aiming point extending into said opening of said housing and a second end disposed at an opposite end of said sighting in than said first end and receiving light from said optical fiber to illuminate said aiming point, said sighting pin including a longitudinal axis substantially perpendicular to said longitudinal axis of said opening.

2. The sight of claim 1, wherein said sighting pin is formed from a self-supporting material.

3. The sight of claim 1, wherein said aiming point includes one of a triangular, circular, oval, or D shape.

4. The sight of claim 1, further comprising a collar supporting said sighting pin relative to said housing.

5. The sight of claim 4, wherein said collar is threadably attached to said housing.

6. The sight of claim 4, wherein said collar and said sighting pin are removably attached to said housing.

7. The sight of claim 1, wherein said optical fiber is formed in a serpentine pattern.

8. The sight of claim 1, wherein said optical fiber is received within a recess formed in said housing.

9. The sight of claim 8, further comprising a rib disposed within said recess and separating strands of said optical fiber.

10. The sight of claim 1, wherein said opening extends through said first end and said second end of said housing.

11. The sight of claim 1, wherein said first end of said sighting pin opposes an inner surface of said housing.

12. The sight of claim 1, further comprising a Tritium lamp in communication with said optical fiber.

13. The sight of claim 1, further comprising an attachment mechanism operable to attach said sight to an external structure.

14. The sight of claim 13, wherein said external structure is one of a Picatinny rail, a Weaver rail, or a dove-tail rail.

15. The sight of claim 1, wherein said sighting pin is a polished fiber.

16. The sight of claim 1, wherein said sighting pin is a clear fiber.

17. The sight of claim 16, wherein said optical fiber is a colored fiber.

18. The sight of claim 1, further comprising a level surrounded by said housing.

19. A sight comprising:

a housing including a first end, a second end, and an opening extending along a longitudinal axis between said first end and said second end;

an optical fiber supported by said housing; and a sighting pin including a first end in optical communication with said optical fiber and a second end that opposes an inner surface of said housing and includes a polished portion that is illuminated with light received from said optical fiber at said first end of said sighting pin to provide the sight with an aiming point.

20. The sight of claim 19, wherein said opening extends through said first end and said second end of said housing.

21. The sight of claim 19, further comprising a collar supporting said sighting pin relative to said housing.

22. The sight of claim 21, wherein said collar is threadably attached to said housing.

23. The sight of claim 21, wherein said collar and said sighting pin are removably attached to said housing.

24. The sight of claim 19, wherein said optical fiber is formed in a serpentine pattern.

25. The sight of claim 19, wherein said optical fiber is received within a recess formed in said housing.

26. The sight of claim 25, further comprising a rib disposed within said recess and separating strands of said optical fiber.

27. The sight of claim 19, further comprising a Tritium lamp in communication with said optical fiber.

28. The sight of claim 19, further comprising an attachment mechanism operable to attach said sight to an external structure.

29. The sight of claim 28, wherein said external structure is one of a Picatinny rail, a Weaver rail, or a dove-tail rail.

30. The sight of claim 19, wherein said sighting pin is a polished fiber.

31. The sight of claim 30, wherein said sighting pin is a clear fiber.

32. The sight of claim 19, wherein said optical fiber is a colored fiber.

33. The sight of claim 19, further comprising a level surrounded by said housing.

* * * * *